United States Patent [19]

Neuroth

[11] 4,453,036

[45] Jun. 5, 1984

[54] OIL WELL CABLE

[75] Inventor: David H. Neuroth, Bethany, Conn.

[73] Assignee: Harvey Hubbell Incorporated, Orange, Conn.

[21] Appl. No.: 429,781

[22] Filed: Sep. 30, 1982

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/103 X |
| 2,165,738 | 7/1939 | Van Hoffen | 174/105 R X |
| 2,391,037 | 12/1945 | Shafer, Jr. | 174/102 SP |
| 2,483,301 | 9/1949 | Roberds | 174/15 C |
| 2,544,233 | 3/1951 | Kennedy | 174/117 R X |
| 2,897,253 | 7/1959 | Davey et al. | 174/109 X |
| 3,351,706 | 11/1967 | Gnerre et al. | 174/105 R |
| 4,196,307 | 4/1980 | Moore et al. | 174/47 |
| 4,277,642 | 7/1981 | Piper et al. | 174/117 R X |
| 4,282,398 | 8/1981 | Solomon | 174/106 R |
| 4,374,530 | 2/1983 | Walling | 174/47 X |

FOREIGN PATENT DOCUMENTS

| | | | |
|---|---|---|---|
| 1020074 | 11/1957 | Fed. Rep. of Germany | 174/117 R X |
| 437525 | 10/1935 | United Kingdom . | |
| 1242494 | 8/1971 | United Kingdom . | |
| 1250823 | 10/1971 | United Kingdom | 174/136 |
| 2069746 | 8/1981 | United Kingdom . | |

*Primary Examiner*—J. V. Truhe

*Attorney, Agent, or Firm*—Jerry M. Presson

[57] ABSTRACT

Disclosed is a flat cable incorporating an elongated, bendable protective structure which is comprised of a central channel member of rigid cross-section for resisting forces applied to a centrally disposed insulated conductor and at least one outer channel member of substantially lesser rigidity for resisting insulation-disruptive forces which may be applied to an insulated conductor adjacent one edge of the cable.

9 Claims, 6 Drawing Figures

OIL WELL CABLE

This invention relates to an electrical cable and more particularly, to a cable for use in an extremely adverse environment, such as those encountered in oil wells.

BACKGROUND OF THE INVENTION

Electrical cables which are used in oil wells must be able to survive and perform satisfactorily under extremely adverse conditions of heat and mechanical stress. Ambient temperatures in wells are often high and the $I^2R$ losses in the cable itself add to the ambient heat. The service life of a cable is known to be inversely related to the temperature at which it operates. Thus, it is important to be able to remove heat from the cable while it is in its operating environment.

Cables are subjected to mechanical stresses in several ways. It is common practice to attach cables to oil pump pipes to be lowered into a well using bands which can, and do, crush the cables, seriously degrading the effectiveness of the cable insulation and strength. The cables are also subjected to axial tension and lateral impact during use.

It is therefore conventional to provide such cables with external metal armor and to enclose the individual conductors within layers of materials chosen to enhance strength characteristics of the cable, but such measures are sometimes not adequate to provide the necessary protection.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the wall, there is not sufficient time for the intrapore pressure to bleed off. As a result of this decompression, the insulation tends to expand outwardly like a balloon and can rupture, rendering the cable useless thereafter.

In U.S. Pat. No. 4,409,431 in which the assignee is the same as the assignee of the instant invention, there is described a cable structure which is particularly suitable for use in such extremely adverse environments. The structure protects the cable against inwardly-directed compressive forces and provides for the dissipation of heat from the cable which is an important feature in high temperature operating environments, for reasons discussed therein, as well as resistance to decompression expansion of the insulation. Supplemental force-resisting members for such structures are disclosed in my copending U.S. patent application Ser. No. 429,530 filed Sept. 30, 1982 and assigned to the same assignee as the present invention.

As described in U.S. Pat. No. 4,409,431 the cable protective structure includes one or more elongated force-resisting members which conform to, and extend parallel and adjacent an insulated conductor comprising the cable. The members are rigid in cross-section to resist compressive forces which would otherwise be borne by the cable conductors. For applications requiring the cable to undergo long-radius bends in service, the elongated support may be formed with a row of spaced-apart slots which extend perpendicularly from the one edge of the member into its body to reduce the cross-sectional rigidity of the member in the slotted areas so as to provide flexibility in the support to large-radius bending about its longitudinal axis.

As described in my copending patent application Ser. No. 390,308 filed June 21, 1982 and assigned to the same assignee as the present invention, for certain service applications, it may be preferred that the electrical insulating sheath on the cable conductor not be in direct contact with the slot openings. This is because the slot openings in the support member may allow highly corrosive materials to gain access to the jacket composition by flowing inwardly through the slots. In addition, the corners formed by the slots may cut into or abrade the underlying cable jacket upon repeated bending of the cable.

The cable protective structure of said copending application Ser. No. 390,308 is made of a composite structure which utilizes an elongated force-resisting member of good thermal conductivity positioned adjacent the insulating conductor sheath. This member comprises a channel member having two substantially parallel elements or legs which are cantilevered from a transverse or vertical leg and which are slotted laterally to impart the requisite long-radius bending in the plane of the vertical leg. The parallel legs may extend in the same direction from the vertical leg toward an adjacent conductor in which case the channel has a U-cross sectional shape. A smooth, bendable liner may be mounted between the three legs of the channel and the outermost layer of insulation of the adjacent conductor to bridge the slots in the member and thereby protect the underlying insulation from abrasion by the slot edges during bending of the channel member.

The exterior jacket or armor, the liners and the channel members all serve to protect the conductor insulation, and hence the cable, from damage caused by vertical crushing, horizontal or lateral (edge) impacts and from damage resulting from decompression expansion.

The vertical legs of the channel members greatly enhance crush resistance and this is true even if the width of each of the vertical channel legs of the outermost channel member is made only about one-half that of the centrally located channel member in a flat three (or more) conductor cable construction. Since the outer two channel members can be reduced in overall thickness, it permits proportionally more insulation to be enclosed by the relatively thinner channel member without necessarily increasing the overall thickness of the cable. The extra thickness of insulation can serve to provide greater resistance to edge or lateral impacts and consequently, if the cable edge is dented, it is more likely that the minimum effective thickness and integrity of conductor insulation will remain uncompromised. Also, during certain steps in the manufacturing process and particularly when the cable is being jacketed or armored with steel tape, the outside insulation may be displaced longitudinally or radially, or otherwise may be deformed. Accordingly, it is advantageous to provide an extra thickness of insulation material on the outside conductors so that the required minimum thickness of insulation will be retained.

As mentioned hereinabove, decompression expansion and rupture tends to occur when the insulation trys to expand due to the presence of compressed gasses trapped within it. Typically, the expanding gas tends to force the insulation outwardly in a radial direction causing conductor insulation on the outside conductors to press against the leading end of the cable and also against the exterior metal jacket or armor. Generally, however, the horizontal force component of these generated forces are balanced in the cable and no net displacement of insulation in the horizontal direction occurs. However, the components of forces in the vertical direction, that are radially-directed and hence, generally perpendicular to the longitudinal axis of the cable, tend to force apart the cantilevered parallel legs of the channel members. In extreme cases, high radial force components generated on decompression could drive apart the parallel legs of a channel member sufficiently to permit the cable insulation to edge flow around the slightly opened legs of the channel member and thus, rupture. The possibility of rupture is greatest for the central conductor because the jacket oftentimes merely spans the parallel legs of the channel members protecting this conductor and hence, does not apply direct restraint for the parallel legs of these central channel members.

However, the channel members located exteriorily and adjacent the outside edges of the cable structure receive radially inwardly-directed restraining forces from the cable jacket or armor because the corrugations thereof loop around the parallel legs of each of these channel members and provide loop strength to those members which resists the outward displacement of their parallel legs. Hence, these channel members need not be made as thick as the center channel members in order to withstand the same decompression forces.

BRIEF DESCRIPTION OF THE INVENTION

The cable construction as described provides the cable with excellent crush resistance, enhanced resistance to edge flows and decompression rupture and other disruptive forces and stresses encountered in adverse operating environments with only a slight increase in the cross-sectional dimensions of the cable.

The instant cable construction also allows less metal to be used in the fabrication of the force-resisting channel members because the exterior jacket provides an effective constraint to the two outer channel members against deformation due to decompression forces. As an additional resulting benefit, the outer channel members can be made thinner and possess a greater flexibility for long-radius bending.

OBJECTS OF THE INVENTION

An object of this invention is to provide a jacketed electrical cable incorporating interior force-resisting members wherein the cable utilizes restraining forces available in the cable jacket to reduce the cross-sectional thickness of at least one of the force-resisting members positioned adjacent one edge of the cable.

Another object of this invention is to provide an electrical cable structure which incorporates a plurality of channel members of different structural characteristics for resisting various disruptive forces encountered in adverse environments, such as oil wells.

Another object of this invention is to provide a flat cable incorporating an elongated, bendable protective structure which is comprised of a central channel member of rigid cross-section for resisting forces applied to a centrally disposed insulated conductor and at least one outer channel member of substantially lesser rigidity for resisting forces which may be applied to an insulated conductor adjacent one edge of the cable.

Yet another object is to provide a cable in accordance with the foregoing objects, for use in extremely adverse environments, which is thermally conductive to dissipate heat and is resistant to edge impacts, decompression rupture and externally applied compressive forces.

Still another object of this invention is to provide a protective structure embodied within an enclosing jacket for an electrical cable which is comprised of channel members of different cross-sectional rigidity.

DETAILED DESCRIPTION OF THE INVENTION

Figure 1:
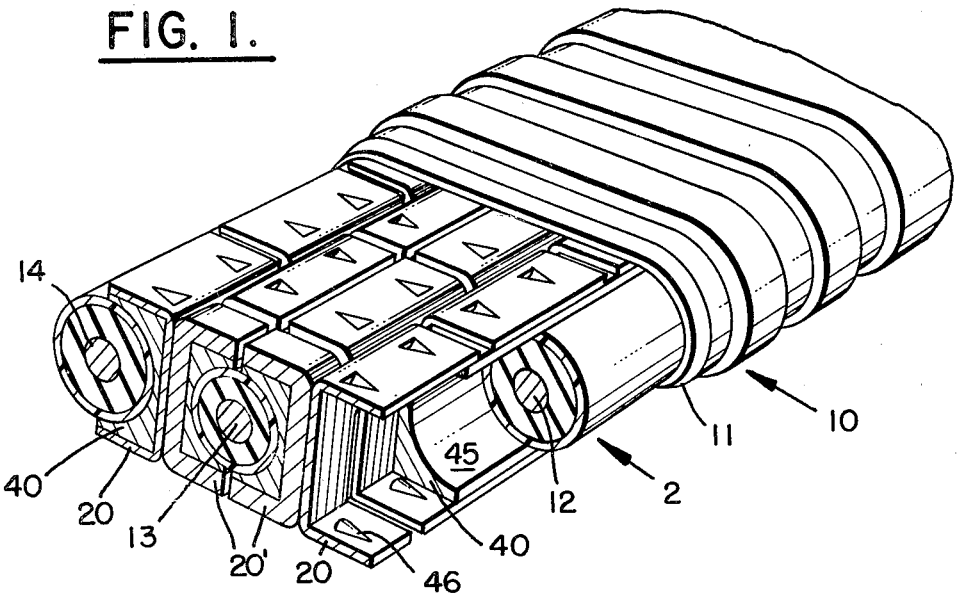
FIG. 1 is a partial perspective sectional view of a length of cable constructed in accordance with this invention, illustrating an end portion with its outer protective jacket removed.

FIG. 1 illustrates one embodiment of a cable 10 constructed in accordance with the present invention which is particularly suitable for use in extremely adverse environments such as oil well applications wherein the cable is subject to very high temperatures and pressures, and to very severe compressive forces and impacts from, for example, hammers, or other tools.

The cable 10 illustrated therein includes an exterior metal protective jacket 11 which surrounds and encloses a plurality of individually insulated conductors 12, 13 and 14. To provide the cable with a flat configuration preferred for oil well applications, the conductors are arranged so that the central axes of the conductors lie parallel and in essentially the same plane.

The jacket 11 is typically formed of metal corrugations or tape wrapped about the conductors 12, 13 and 14 in helical fashion. The juxtaposed conductors are of considerable length, as needed, it being understood that only a very short length of the cable is illustrated in FIG. 1. Assuming the cable 10 is comprised of three conductors, each of the two outer conductors 12 and 14 are at least partially enclosed by a channel member 20.

The channel member 20 is made of a material which is substantially rigid in cross-section and which is selected to have good thermal conductivity properties; specifically, a thermal conductivity which is at least greater than the thermal conductivity of the conductor insulation. Fiber-filled carbon compositions are suitable for this purpose, and also exhibit good compression resistance. Metals such as steel and aluminum are also suitable for this purpose, as are metal-filled curable polymeric materials.

Figure 2:
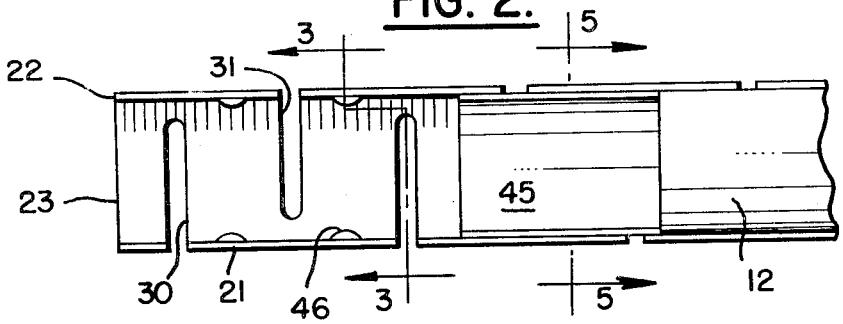
FIG. 2 is a side elevational view of an outer one of the insulated conductors comprising the cable of FIG. 1 as viewed in the direction of arrow 2 of FIG. 1 depicting its protective liner and channel members.
Figure 3:
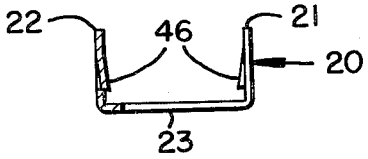
FIG. 3 is a sectional end view of a force-resisting channel member for protecting an outer one of the cable conductors; the view being taken along section line 3—3 of FIG. 2.
Figure 4:
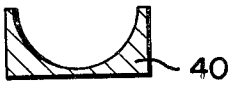
FIG. 4 is a sectional end view of a liner component for the interior of the channel member of FIG. 3.

As best seen in FIG. 4, each channel 20 is essentially of identical U cross-sectional shape formed by a pair of elements or legs 21 and 22, respectively, which are substantially flat, parallel and horizontal as viewed in FIGS. 1 and 2, so that they conform to the respective upper and lower flat surfaces of the metallic jacket 11.

The channels 20 may cut from predetermined lengths of a continuous strip of flat stock material and then bent to the described U configuration. The lateral legs of the members 20 are joined by a rigid, vertical element or leg 23 which is slightly longer than the overall diameter of the conductor and its covering layer or layers of insulation. As will be seen, the cross-sectional shape of each member 20 is that of a substantially U-shaped channel with the legs 21 and 22 facing outwardly of the cable and extending approximately up to a vertical plane passing through the center of the associated adjacent conductor 12 or 14 which faces the open side of the U channel. Hence, the legs 21 and 22 extend from the vertical leg 23 to each side of this conductor a distance which is about equal to the maximum radius of the conductor plus all of its insulation covering. Crushing forces applied to the cable jacket 11, especially in directions perpendicular to the longitudinal axis of the cable 10, will be resisted by the channels 20 which are rigid in cross-section and damage to the conductor insulation by such forces will thereby be resisted. Thus, when the cable is attached to an element such as a well pipe or oil recovery motor by metal bands or straps, a situation which often causes crushing of a cable, the band engages the outside of the armor 11 and the rigid channels 20 prevent inwardly directed disruptive forces from being transmitted to the underlying layer or layers of insulation.

The channels 20 should also have a degree of bidirectional flexibility and resilience which can permit the cable to undergo long-radius bends as necessary when installing the cable in a service location. This is provided by a first row of slots 30 (FIG. 2) extending inwardly through each of the channel legs 21 and perpendicularly through the joining leg 23 and terminating approximately at the bend where the leg 23 joins the opposite leg 22. The slots 30 are substantially uniformly spaced apart in the longitudinal direction of the channel and thereby divide the channel 20 into a succession of individual, flexibly interconnected channel segments. Longitudinally and alternately spaced between slots 30 is a second and opposite row of slots 31 which extend perpendicularly into the body of each channel 20 from leg 22 to the bend where the leg 21 meets the leg 23. Slots 31 are also substantially uniformly spaced apart in the longitudinal direction, and lie approximately midway between slots 30. Thus, the slots 30 and 31 extend inwardly alternately from the legs 21 and 22, respectively, and impart greater bidirectional flexibility to the channels 20 in the major plane of cable bending; that is, in a plane perpendicular to the plane passing through the centers of the cable conductors 12, 13 and 14.

Figure 5:
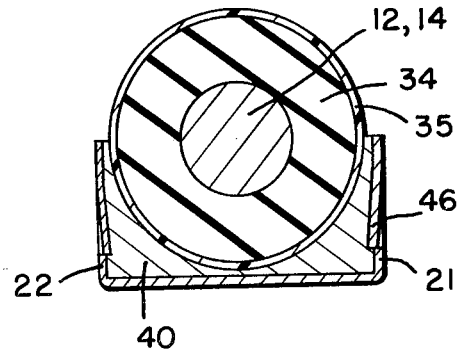
FIG. 5 is an end sectional view of a composite liner and channel structure for each of the two outer cable conductors taken along section line 5—5 of FIG. 2.

Each of the conductors 12 and 14 may be of stranded or solid metallic material, and as best seen in FIGS. 1 and 5, each conductor is covered or sheathed by one or more concentric layers of suitable electrical insulation. Two of such insulating layers are shown and designated 34 and 35, respectively, in FIG. 5. The layers 34 and 35 are typically composed of plastic or rubber components which are relatively soft and therefore may have the surfaces cut or abraded by rubbing or other direct contact with harder or more rigid surfaces such as used in the force-resisting channels 20. Any such cutting or abrasion of the conductor insulation may seriously degrade its coating and insulating characteristics.

The slots 30 and 31 cut into the channels 20, in particular, may result in sharp edges and corners being formed on the inside of the channels 20 which might abrade the softer insulating layer 35 placed in immediate contact with a channel 20, especially if the channel 20 is formed from steel or aluminum stock.

To prevent such abrasion, an elongated liner is inserted into the open U of each channel 20. The liners, one of which is designated by the numeral 40, have substantially flat, opposite surfaces abutting and coextensive with the inner surfaces of legs 21 and 23. A semi-circular edge surface 45 is formed on the liner to conform to the cylindrical, outermost insulating layer 35 of underlying insulation. Each liner 40 is made sufficiently continuous to bridge or span the inner corners and edges formed by the slots 30 and 31, thereby spacing these edges from direct contact with the insulation on the underlying conductor core.

The liners 40 are preferably somewhat flexible so as to bend through arcs simultaneously with its associated overlying channel 20 in directions substantially perpendicular to the major bending plane (that is, the longitudinal axis) of the cable 10. For oil well applications, the liners 40 are preferably composed of a material having good thermal conductivity to dissipate the heat applied to the cable 10 in such environments. The liner material should be relatively smooth to slide on the outermost insulating jacket 35, especially during bending of the latter. A suitable metallic material for the liners is lead, which has a smooth surface for facilitating sliding upon the relatively resilient layers of insulation and yet provides good thermal conductivity. Other suitable metallic or nonmetallic materials may also be used for the liners. The liners also afford a measure of protection to the insulation of the conductors against contact with, and possible attack by, insulation-degrading and corrosive chemicals.

By forming each of the force-resisting members as a composite of a flat channel 20 and a liner component 40 which can be inserted into the channel 20, the manufacture of the force-resisting memvers is facilitated. As is the case with the channels 20, the individual liners 40 can be manufactured by cutting the requisite lengths from a longer, continuous length of suitably sized and shaped strip of liner material.

The liners 40 may be fixedly mounted in their respective channels 20 by merely dimpling, semi-piercing or coining inwardly small surface areas on the opposite legs 21 and 22 of the channels 20 to form inwardly projecting protuberances or barbs 46. The opposing protuberances 46 cooperate to grip therebetween the upper and lower surfaces of the liners 40 forcibly pressed into associated channel members with their concave surfaces 45 facing the same direction as that of the interior of the channel U.

Figure 6:
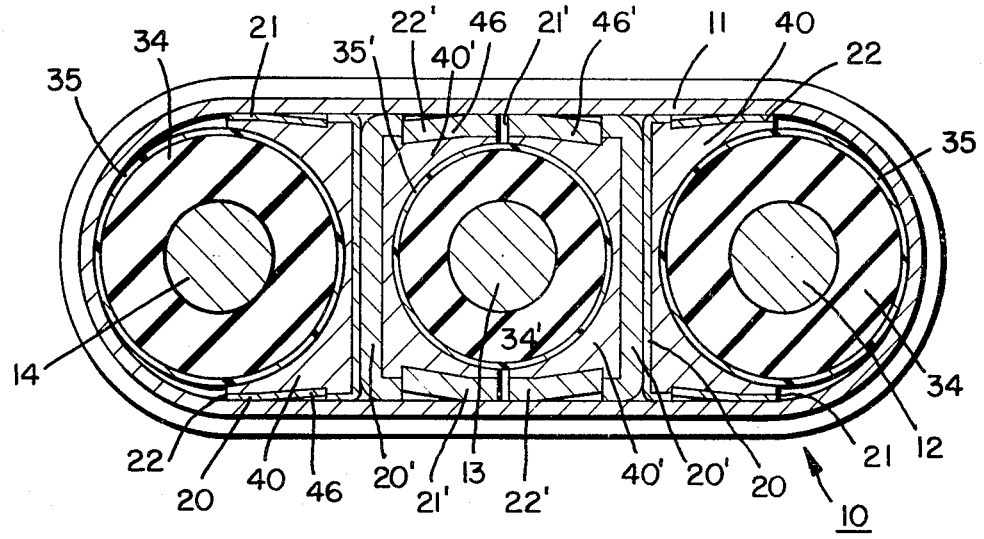
FIG. 6 is an end sectional view of a cable in accordance with this invention.

For reasons discussed hereinafter, the central conductor 13 is protected by a pair of oppositely facing channels 20′ and a pair of oppositely facing liners 40′, each of which is mounted in a channel as best seen in FIGS. 1 and 6. The channels 20′ are also of substantially U shape and may be formed of the same material as the aforedescribed channels 20. The oppositely facing liners 40′ are similar in shape to that of the liners 40 and may be formed of the same material as the aforedescribed liners 40. Each of the liners 40′ is retained fixedly in an associated channel 20′ by a series of barbs 46′, of the same shape and provided for the same purpose as the aforedescribed barbs 46.

The central conductor 13 is covered by a primary layer of insulation 34′, typically of the same composition as the aforedescribed primary layer of insulation 34.

The layer 34' is covered by a thinner layer of insulation 35', which is typically of the same composition as that of the aforedescribed secondary layer 35.

From the foregoing it will be apparent that the exterior jacket and the channel members serve to protect the conductor insulation, and hence, the cable, from damage caused by vertical crushing, horizontal or lateral (edge) impacts and from damage resulting from decompression expansion.

The vertical legs of the channel members greatly enhance crush resistance and this is true even if the width of each of the vertical channel legs of the outermost channel member 20 is made only about one-half that of the centrally located channel members 20'. Since the outer two channel members 20 can be reduced in cross-sectional thickness, it permits proportionally more insulation to be used in the layers 34 and 35 enclosed by the relatively thinner channel member 20 than enclosed by the relatively thicker channel 20' without appreciably increasing the overall thickness of the cable 10.

The extra thickness of insulation in the layers 34 and 35 compared to the layers 34' and 35' can serve to provide greater resistance to edge or lateral impacts and consequently, if the edge of the cable 10 is dented, it is more likely that the minimum effective thickness and integrity of insulation layers 34 and 35 will remain uncompromised. Also, during certain steps in the manufacturing process and particularly when the cable 10 is being jacketed or armored with the metal tape, one or more of the layers of insulation may be displaced longitudinally or radially, or otherwise may be deformed. Accordingly, it is advantageous to provide an extra thickness of at least primary insulation material 34 on the outside conductors 12 and 14, respectively, so that the required minimum thickness of at least the primary insulation will always be ensured.

Decompression rupture may occur when the primary layers of insulation 34 and 34', respectively, try to expand due to the presence of compressed gasses trapped within it. Typically, the expanding gas tends to force the insulation outwardly of the conductors causing the associated layer of insulation to press against the leading end of the cable 10 and also against the armor 11. Generally, however, the horizontal force component of these generated forces are balanced in the cable and no net displacement of insulation 34 or 34' in the horizontal direction occurs. However, the components of forces in the vertical direction, that are radially-directed and hence, generally perpendicular to the longitudinal axis of the cable 10, tend to force apart the thinner parallel legs 21 and 22 of the channel members 20. In extreme cases, were it not for the jacket 11, high radial force components generated on decompression might drive apart these thinner legs sufficiently to permit the layers of cable insulation 35 and/or 34 to edge flow around a slightly outwardly displaced leg 21 or 22 of a channel member 20 and in such cases cause a complete rupture of the layers 35 and/or 34. The possibility of insulation rupture is greatest for the central conductor 13 and hence, the jacket 11 does not exert a counterrestraint to outward displacement of the parallel legs 21' and 22' of the channel members 20'. Hence, the central channel members 20' are made of thicker cross-section than the outer channels 20. Typically, the cross-sectional dimensions of the legs 21' or 22' of the central channel members 20' is twice that of the legs 21 or 22, respectively, of the member 20.

However, the channel members 20 located exteriorily and adjacent the outside edges of the cable structure 10 receive radially inwardly-directed restraining forces from the cable jacket 11 because the tape turns forming the jacket loop around the parallel legs 21 and 22 of each of these channel members 20 and serve as a loop to resist the outward displacement of the legs 21 and 22. Hence, these channel members 20 need not be made as thick as the center channel members 20' in order to withstand the same decompression forces.

The instant cable construction also allows less metal to be used in the fabrication of the channel members 20 because the exterior jacket 11 provides an effective constraint to these channel members against deformation due to decompression forces. As an additional resulting benefit, the channel members 20 can be made thinner than the channel member 20' and hence, enhance the overall flexibility of the cable 10.

While various advantageous embodiments have been chosen to illustrate the invention, it will be understood by those skilled in the art that various changes and modifications can be made therein without departing from the scope of the invention as defined in the appended claims.

What is claimed is:

1. An improved electrical cable comprising:

a plurality of elongated electrical conductors having substantially parallel spaced apart axes, lying substantially in one plane, electrical insulation surrounding individual ones of said conductors for electrically insulating each of said conductors;

a first and second discrete elongated member each having a first leg portion lying substantially parallel to the one plane and extending toward and adjacent the outermost surface of the insulation covering a different one of the conductors, said first and second members each having a second leg portion lying substantially parallel to a second plane substantially perpendicular to said one plane and joined to a respective one of a first leg portion;

the second leg portions of said first and second members being less compressible in directions parallel to said second plane than the insulating material on the adjacent one of the conductors and the cross-sectional dimension of said second leg portion of said first member being greater than the cross-sectional dimension of said second leg portion of said second member; and a jacket surrounding said first and second members.

2. The cable according to claim 1 wherein each of said first and second members has a third leg portion joined to a respective one of said second leg portions, each said third portion extending substantially parallel to a first leg portion having a common second leg portion.

3. The cable according to claim 2 wherein said first and third leg portions extend in the same direction from a common one of said second leg portions, whereby each of said first and second members are of substantially U cross-sectional shape.

4. The cable according to claim 3 wherein said first and second members are rigid in cross-section.

5. The cable according to claims 1 or 3 wherein there are three of said conductors and a pair of the first members and a pair of the second members, the second members partially enclosing the insulation on different ones of the outermost two conductors and the pair of said first members at least partially enclosing the insulation on opposite portions of the innermost conductor.

6. The cable according to claim 1 wherein said first and second members have greater thermal conductivity than that of the electrical insulation on said conductors.

7. The cable according to claim 5 wherein said first leg portion of said first member has a greater cross-section than that of said first leg portion of said second member.

8. The cable according to claim 7 wherein said second leg portion of said first member has a greater cross-section than said second leg portion of said second member.

9. The cable according to claim 4 wherein the cross-sectional rigidity of said first member is greater than that of said second member.

* * * * *